US010294794B2

(12) United States Patent
Reed

(10) Patent No.: US 10,294,794 B2
(45) Date of Patent: May 21, 2019

(54) GAS TURBINE ENGINE

(71) Applicant: ROLLS-ROYCE PLC, London (GB)

(72) Inventor: Julian Mark Reed, Derby (GB)

(73) Assignee: ROLLS-ROYCE plc, London (GB)

( * ) Notice: Subject to any disclaimer, the term of this patent is extended or adjusted under 35 U.S.C. 154(b) by 887 days.

(21) Appl. No.: 14/835,342

(22) Filed: Aug. 25, 2015

(65) Prior Publication Data

US 2016/0084086 A1 Mar. 24, 2016

(30) Foreign Application Priority Data

Sep. 23, 2014 (GB) ..... 1416764.7

(51) Int. Cl.

| | |
|---|---|
| ***F01D 5/06*** | (2006.01) |
| ***F01D 21/04*** | (2006.01) |
| ***F04D 29/52*** | (2006.01) |
| ***F01D 25/24*** | (2006.01) |

(52) U.S. Cl.

CPC ..... *F01D 5/06* (2013.01); *F01D 21/045* (2013.01); *F01D 25/24* (2013.01); *F04D 29/526* (2013.01); *F05D 2220/32* (2013.01); *F05D 2220/36* (2013.01); *F05D 2230/60* (2013.01)

(58) Field of Classification Search

CPC ..... F01D 21/045; F01D 25/24; F01D 5/06; F01D 11/005; F04D 29/526; F05D 2220/32; F05D 2220/36; F05D 2230/60; F02C 7/04

USPC ..... 416/2; 415/134

See application file for complete search history.

(56) References Cited

U.S. PATENT DOCUMENTS

| | | | |
|---|---|---|---|
| 4,188,037 | A | 2/1980 | Abbes et al. |
| 4,551,064 | A | 11/1985 | Pask |
| 5,158,430 | A | 10/1992 | Dixon et al. |
| 5,823,741 | A | 10/1998 | Predmore et al. |

(Continued)

FOREIGN PATENT DOCUMENTS

| | | | |
|---|---|---|---|
| EP | 545589 | A1 | 6/1993 |
| EP | 1 589 195 | A1 | 10/2005 |

(Continued)

OTHER PUBLICATIONS

Jan. 30, 2018 European Office Action issued in European Patent Application No. EP 15 182 278.0.

(Continued)

*Primary Examiner* — Mark A Laurenzi
*Assistant Examiner* — Paul W Thiede
(74) *Attorney, Agent, or Firm* — Oliff PLC

(57) ABSTRACT

A fan containment system for fitment around an array of radially extending fan blades mounted on a hub in an axial gas turbine engine. The fan containment system comprises a fan case having an annular casing element for encircling an array of fan blades and a hook projecting in a generally radially inward direction from the annular casing element. An annular fan track liner is provided comprising a first fan track liner panel positioned circumferentially adjacent a second fan track liner panel. A coupling connects the first fan track liner panel to the second fan track liner panel and the first fan track liner panel and the second fan track liner panel each comprise a groove along an axial face thereof and a portion of the coupling is received in each of said grooves.

13 Claims, 7 Drawing Sheets

(56) References Cited

U.S. PATENT DOCUMENTS

| | | | |
|---|---|---|---|
| 5,997,247 | A | 12/1999 | Arraitz et al. |
| 6,431,825 | B1 | 8/2002 | McLean |
| 7,360,769 | B2 | 4/2008 | Bennett |
| 7,527,472 | B2 | 5/2009 | Allen |
| 7,744,096 | B2 | 6/2010 | Kono |
| 2010/0247005 | A1 | 9/2010 | Aschenbruck et al. |
| 2011/0164965 | A1 | 7/2011 | Smith et al. |

FOREIGN PATENT DOCUMENTS

| | | | | |
|---|---|---|---|---|
| EP | 2 620 652 | A1 | 7/2013 | |
| EP | 2767676 | A1 * | 8/2014 | ..... F02C 7/04 |
| GB | 1580884 | A | 12/1980 | |
| GB | 2385642 | B | 1/2004 | |
| GB | 2481481 | A | 12/2011 | |
| WO | 14173411 | A1 | 9/2014 | |

OTHER PUBLICATIONS

Feb. 1, 2016 Search Report issued in European Patent Application No. 15182278.

Mar. 11, 2015 Search Report issued in Great Britain Patent Application No. 1416764.7.

* cited by examiner

GAS TURBINE ENGINE

FIELD OF INVENTION

The present invention relates to a fan containment system, a casing assembly, a fan and/or a gas turbine engine.

BACKGROUND

Turbofan gas turbine engines (which may be referred to simply as 'turbofans') are typically employed to power aircraft. Turbofans are particularly useful on commercial aircraft where fuel consumption is a primary concern. Typically a turbofan gas turbine engine will comprise an axial fan driven by an engine core. The engine core is generally made up of one or more turbines which drive respective compressors via coaxial shafts. The fan is usually driven directly off an additional lower pressure turbine in the engine core.

The fan comprises an array of radially extending fan blades mounted on a rotor and will usually provide, in current high bypass gas turbine engines, around seventy-five percent of the overall thrust generated by the gas turbine engine. The remaining portion of air from the fan is ingested by the engine core and is further compressed, combusted, accelerated and exhausted through a nozzle. The engine core exhaust mixes with the remaining portion of relatively high-volume, low-velocity air bypassing the engine core through a bypass duct.

To satisfy regulatory requirements, such engines are required to demonstrate that if part or all of a fan blade were to become detached from the remainder of the fan, that the detached parts are suitably captured within the engine containment system.

The fan is radially surrounded by a fan casing. It is known to provide the fan casing with a fan track liner and a containment system designed to contain any released blades or associated debris. Often, the fan track liner can form part of the fan containment system.

The fan track liner typically includes an annular layer of abradable material which surrounds the fan blades. During operation of the engine, the fan blades rotate freely within the fan track liner. At their maximum extension of movement and/or creep, or during an extreme event, the blades may cut a path into this abradable layer creating a seal against the fan casing and minimising air leakage around the blade tips.

A fan track liner is required to be strong enough to resist ice impact whilst allowing a detached fan blade to penetrate and be contained therewithin. In recent years there has been a trend towards the use of lighter fan blades, which are typically either of hollow metal or of composite construction. These lighter fan blades have similar impact energy per unit area as an ice sheet, which makes it more difficult to devise a casing arrangement that will resist the passage of ice and yet not interfere with the trajectory of a released fan blade.

A conventional fan containment system or arrangement 100 is illustrated in FIG. 1 and surrounds a fan comprising an array of radially extending fan blades 40. Each fan blade 40 has a leading edge 44, a trailing edge 45 and fan blade tip 42. The fan containment arrangement 100 comprises a fan case 150. The fan case 150 has a generally frustoconical or cylindrical annular casing element 152 and a hook 154. The hook 154 is positioned axially forward of an array of radially extending fan blades 40. A fan track liner 156 is mechanically fixed or directly bonded to the fan case 150. The fan track liner 156 may be adhesively bonded to the fan case 150. The fan track liner 156 is provided as a structural filler to bridge a deliberate gap provided between the fan case 150 and the fan blade tip 42.

The fan track liner 156 has, in circumferential layers, an attrition liner 158 (also referred to as an abradable liner or an abradable layer), an intermediate layer which in this embodiment is a honeycomb layer 160, and a septum 162. The septum layer 162 acts as a bonding, separation, and load spreading layer between the attrition liner 158 and the honeycomb layer 160. The honeycomb layer 160 may be an aluminium honeycomb. The tips 42 of the fan blades 40 are intended to pass as close as possible to the attrition liner 158 when rotating. The attrition liner 158 is therefore designed to be abraded away by the fan blade tips 42 during abnormal operational movements of the fan blade 40 and to just touch during the extreme of normal operation to ensure the gap between the rotating fan blade tips 42 and the fan track liner 156 is as small as possible without wearing a trench in the attrition liner 158. During normal operations of the gas turbine engine, ordinary and expected movements of the fan blade 40 rotational envelope cause abrasion of the attrition liner 158. This allows the best possible seal between the fan blades 40 and the fan track liner 156 and so improves the effectiveness of the fan in driving air through the engine.

The purpose of the hook 154 is to ensure that, in the event that a fan blade 40 detaches from the rotor of the fan 12, the fan blade 40 will not be ejected through the front, or intake, of the gas turbine engine. During such a fan-blade-off event, the fan blade 40 travels tangentially to the curve of rotation defined by the attached fan blades. Impact with the containment system (including the fan track liner 156) of the fan case 150 prevents the fan blade 40 from travelling any further outside of the curve of rotation defined by the attached fan blades. The fan blade 40 will also move forwards in an axial direction, and the leading edge 44 of the fan blade 40 collides with the hook 154. Thus the fan blade 40 is held by the hook 154 and further axially forward movement is prevented. A trailing blade (not shown) then forces the held released blade rearwards where the released blade is contained. Thus the fan blade 40 is unable to cause damage to structures outside of the gas turbine engine casings.

As can be seen from FIG. 1, for the hook 154 to function effectively, a released fan blade 40 must penetrate the attrition liner 158 in order for its forward trajectory to intercept with the hook. If the attrition liner 158 is too hard then the released fan blade 40 may not sufficiently crush the fan track liner 156.

However, the fan track liner 156 must also be stiff enough to withstand the rigours of normal operation without sustaining damage. This means the fan track liner 156 must be strong enough to withstand ice and other foreign object impacts without exhibiting damage for example. Thus there is a design conflict, where on one hand the fan track liner 156 must be hard enough to remain undamaged during normal operation, for example when subjected to ice impacts, and on the other hand allow the tip 42 of the fan blade 40 to penetrate the attrition liner 158. It is a problem of balance in making the fan track liner 156 sufficiently hard enough to sustain foreign object impact, whilst at the same time, not be so hard as to alter the preferred hook-interception trajectory of a fan blade 40 released from the rotor. Ice that impacts the fan casing rearwards of the blade position is resisted by an ice impact panel 164.

An alternative fan containment system is indicated generally at 200 in FIG. 2. The fan containment system 200 includes a fan track liner 256 that is connected to the fan casing 250 at both an axially forward position and an axially rearward position. At the axially forward position, the fan track liner is connected to the casing at hook 254 via a fastener 266. In the event of a fan blade detaching from the remainder of the fan, the fan blade impacts the fan track liner 256 and the fan track liner pivots about the rearward position of attachment to the casing (indicated at 268 in FIG. 2). Such an arrangement is often referred to as a trap door arrangement. The trap door arrangement has been found to help balance the requirements for stiffness of the fan track liner with the requirements for resistance of operational impacts (e.g. ice impacts) ensuring a detached blade is held within the engine.

The fan track liner may be formed of a plurality of arcuate panels positioned substantially coaxially so as to form a cylindrical or frustoconical fan track liner. When the fan containment system has a trap door arrangement, the trajectory of a released fan blade or a released part of a fan blade (reference to a released fan blade from hereon in refers to both a released fan blade and a released part of a fan blade) can cross the boundary from one fan track liner panel to another. When a fan blade is released the trap door of a first fan track liner panel will be activated. However, the trap door of adjacent fan track liner panels will remain closed unless a sufficient force is applied to open them. This means that a step is present between the fan track liner panel where the trap door has been activated and the fan track liner panel where the trap door has not yet been activated. The step creates a barrier to a released fan blade, so there is a concern that the released fan blade may skip over the hook and avoid containment.

A contemplated solution to this problem is to adhesively bond adjacent panels together. However, the use of adhesive creates problems for both assembly and on-wing repair. An advantage of providing a fan track liner made from a plurality of panels is that liner damage can be quickly and effectively addressed whilst the engine is on-wing with minimum disruption. If an adhesive is used this advantage is reduced because of the need to remove adhesive from the panels and wait for adhesive to cure once repair work is complete.

SUMMARY OF INVENTION

The present invention seeks to address one or more of the problems associated with fan containment systems of gas turbine engines of the prior art.

A first aspect provides a fan containment system for fitment around an array of radially extending fan blades mounted on a hub in an axial gas turbine engine. The fan containment system comprises a fan case having an annular casing element for encircling an array of fan blades and a hook projecting in a generally radially inward direction from the annular casing element. The fan containment system further comprises an annular fan track liner. The fan track liner comprises a first fan track liner panel positioned circumferentially adjacent a second fan track liner panel. Each of the first and second fan track liner panels may be connected the fan case at the hook via one or more connectors configured to permit movement of the respective first or second fan track liner panel relative to the hook such that the first and/or second fan track liner panel can pivot towards the annular casing element when a released fan blade impacts the first and/or second fan track liner panel. A coupling connects the first fan track liner panel to the second fan track liner panel. The first fan track liner panel and the second fan track liner panel each comprise a groove along an axial face thereof and a portion of the coupling is received in each of said grooves.

As will be appreciated by the person skilled in the art, the coupling provides a connection between adjacent fan track liner panels. This connection can help to reduce vibration of the fan track liner panels during operation of the gas turbine engine.

The coupling can contribute to improved fan blade capture performance. In fan containment systems of the prior art having a plurality of fan track liner panels, when a fan blade or part of a fan blade is released, if the fan blade impacts a junction between two adjacent fan track liner panels at a position close to the hook then there is a risk that the adjacent panel will not move towards the annular casing element and so the released fan blade can "jump" over the hook instead of being retained. The connection created by the coupling increases the likelihood of the adjacent panel moving towards the annular casing element and therefore the released fan blade being retained by the fan containment system.

Circumferential ends of the coupling may be bulbous in shape. For example the coupling may have an elongate central section extending between two bulbous ends, e.g. the central section may have a rectangular cross section and the ends may have a circular cross section. The shape of the coupling may be considered to be a dog-bone shape.

The coupling may be configured to be more flexible in an axial direction than in a circumferential direction.

The coupling may be configured to be more flexible in an axial direction than in a radial direction.

Increased flexibility in the axial direction aids insertion and removal of the coupling from the groove of the first and second fan track liner panels, whilst reduced flexibility in the circumferential and/or radial direction aids in transferring an impact force from the first fan track liner panel to the second fan track liner panel. The flexibility of the coupling in the circumferential direction and/or radial direction can be selected so as to accommodate casing distortion.

The coupling may be coated to enhance directional stiffening properties of the coupling (e.g. to increase the stiffness of the coupling in the axial direction).

The coupling may be coated with an anti-corrosion coating and/or a friction reducing coating.

The fan containment system may comprise a sealant provided on a radially inner surface of the coupling and forming a portion of the gas washed surface of the fan containment system.

The first and the second panels may be substantially rectangular in shape. That is the first and second fan track liner panels may have longitudinal sides extending substantially parallel to the axial direction.

The coupling may extend along a forward portion of the first and second fan track liner panels.

The coupling may extend along an entire length of the first and second fan track liner panels.

The groove provided in the first and second fan track liner panels may be curved towards the gas washed surface in a direction away from the hook.

The fan case may comprise a standoff positioned downstream of the hook. The first and the second fan track liner panels may be removably connected to the standoff.

The fan track liner may comprise a plurality of fan track liner panels and a plurality of couplings. Each fan track liner panel may have a groove extending along an axial face thereof. One coupling may be positioned between each pair of adjacent fan track liner panels so as to connect adjacent fan track liner panels. That is, one coupling may be partially received in opposing grooves of each pair of fan track liner panels.

A second aspect provides a fan containment system for fitment around an array of radially extending fan blades mounted on a hub in an axial gas turbine engine. The fan containment system may comprise a fan case having an annular casing element for encircling an array of fan blades and a hook projecting in a generally radially inward direction from the annular casing element. The fan containment system may comprise an annular fan track liner comprising a plurality of fan track liner panels and a plurality of couplings. Each fan track liner panel may comprise a groove extending along both axial faces thereof. One of the plurality of couplings is partially received in opposing grooves of adjacent fan track liner panels.

The fan containment system of the second aspect may comprise one or more optional features of the fan containment system of the first aspect.

A third aspect provides a gas turbine engine comprising the fan containment system according to the first or second aspects.

A fourth aspect provides a method of assembly of a fan containment system. The method comprises providing a fan case having an annular casing element for encircling an array of fan blades and a hook projecting in a generally radially inward direction from the annular casing element. The method comprises connecting a first fan track liner panel to the annular casing element and connecting a second fan track liner panel to the annular casing. The second fan track liner panel is positioned circumferentially adjacent the first fan track liner panel, and the first and second fan track liner panels comprise a groove along an axial side. The method further comprises sliding a coupling along the groove of the first and second fan track liner panel, such that the coupling connects the first fan track liner panel to the second fan track liner panel.

The fan containment system may be the fan containment system of the first or second aspect.

DESCRIPTION OF DRAWINGS

The invention will now be described, by way of example only, with reference to the accompanying drawings in which.

DETAILED DESCRIPTION

Figure 1:
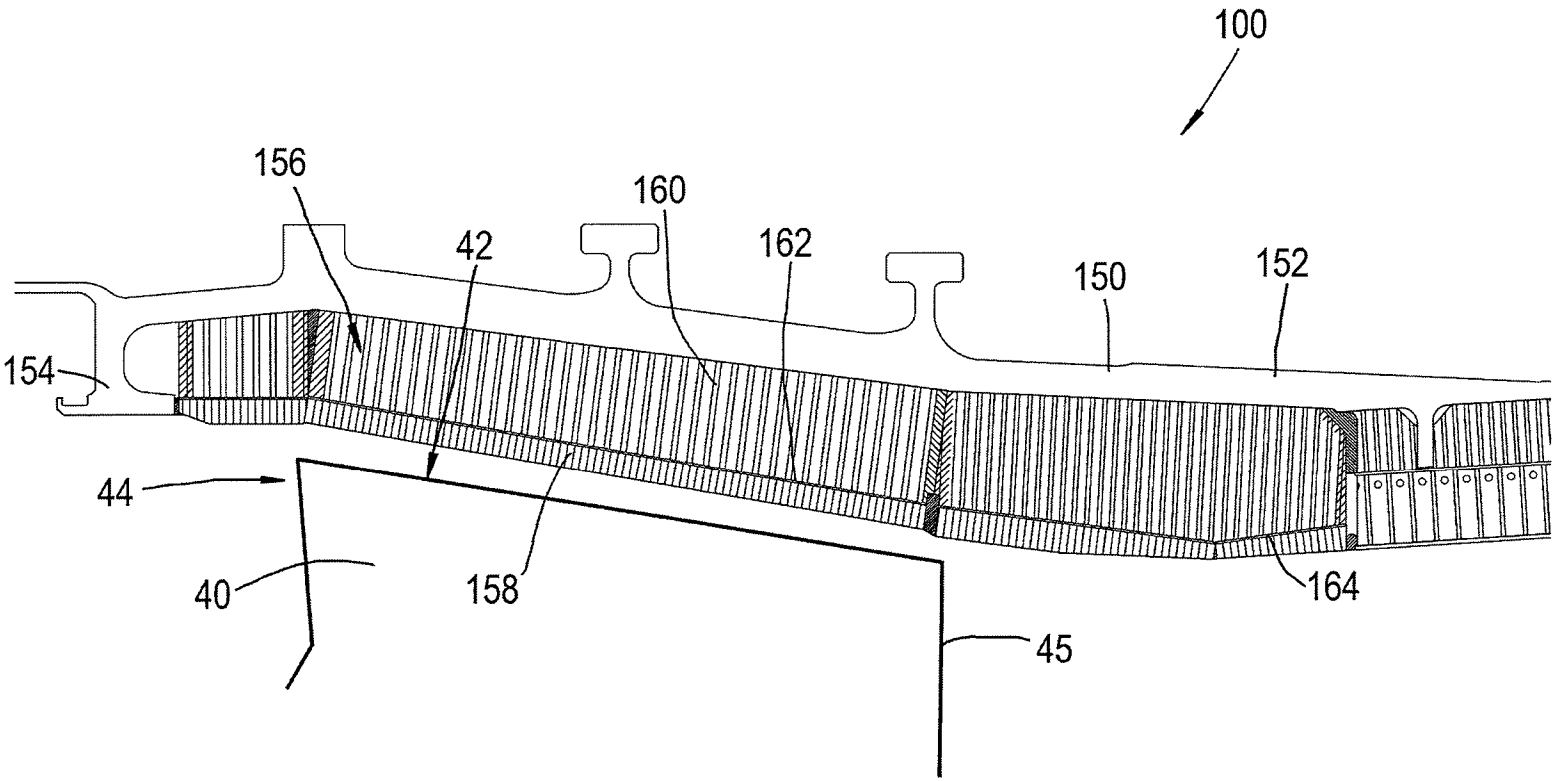
FIG. 1 is a partial view of a cross-section through a typical fan case arrangement of a gas turbine engine of the prior art.
Figure 2:
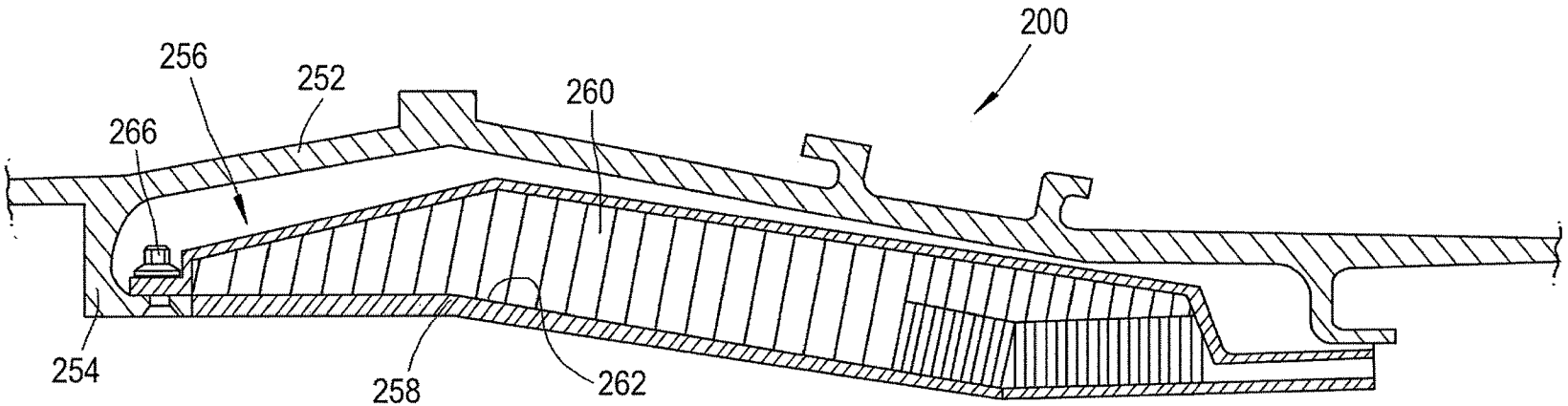
FIG. 2 is a partial view of a cross-section through an alternative fan case arrangement of a gas turbine engine of the prior art.
Figure 3:
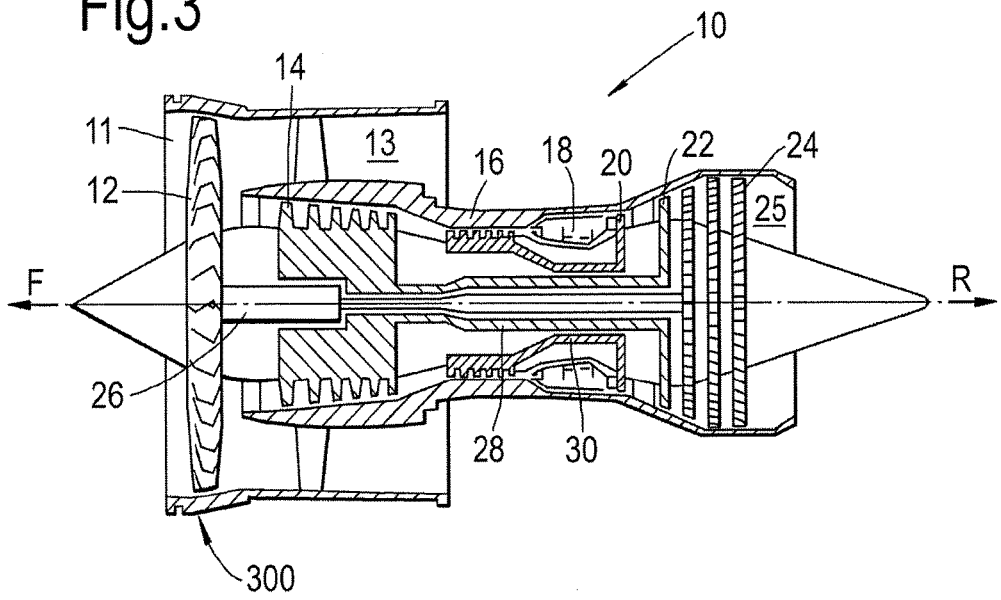
FIG. 3 is a cross-section through the rotational axis of a high-bypass gas turbine engine.

With reference to FIG. 3 a bypass gas turbine engine is indicated at 10. The engine 10 comprises, in axial flow series, an air intake duct 11, fan 12, a bypass duct 13, an intermediate pressure compressor 14, a high pressure compressor 16, a combustor 18, a high pressure turbine 20, an intermediate pressure turbine 22, a low pressure turbine 24 and an exhaust nozzle 25. The fan 12, compressors 14, 16 and turbines 20, 22, 24 all rotate about the major axis of the gas turbine engine 10 and so define the axial direction of the gas turbine engine.

Air is drawn through the air intake duct 11 by the fan 12 where it is accelerated. A significant portion of the airflow is discharged through the bypass duct 13 generating a corresponding portion of the engine thrust. The remainder is drawn through the intermediate pressure compressor 14 into what is termed the core of the engine 10 where the air is compressed. A further stage of compression takes place in the high pressure compressor 16 before the air is mixed with fuel and burned in the combustor 18. The resulting hot working fluid is discharged through the high pressure turbine 20, the intermediate pressure turbine 22 and the low pressure turbine 24 in series where work is extracted from the working fluid. The work extracted drives the intake fan 12, the intermediate pressure compressor 14 and the high pressure compressor 16 via shafts 26, 28, 30. The working fluid, which has reduced in pressure and temperature, is then expelled through the exhaust nozzle 25 generating the remainder of the engine thrust.

The intake fan 12 comprises an array of radially extending fan blades 40 that are mounted to the shaft 26. The shaft 26 may be considered a hub at the position where the fan blades 40 are mounted. FIG. 3 shows that the fan 12 is surrounded by a fan containment system 300 that also forms one wall or a part of the bypass duct 13.

In the present application a forward direction (indicated by arrow F in FIG. 3) and a rearward direction (indicated by arrow R in FIG. 3) are defined in terms of axial airflow through the engine 10.

Figure 5:
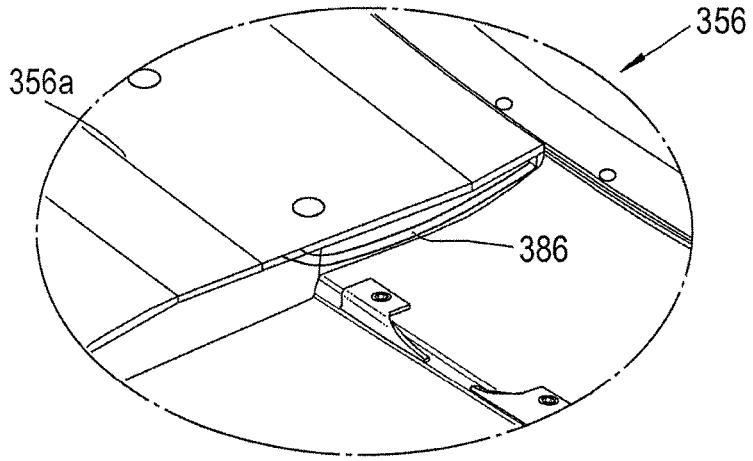
FIG. 5 is a partial perspective view of a forward portion of a fan track liner panel of the fan blade containment system of FIG. 4.
Figure 4:
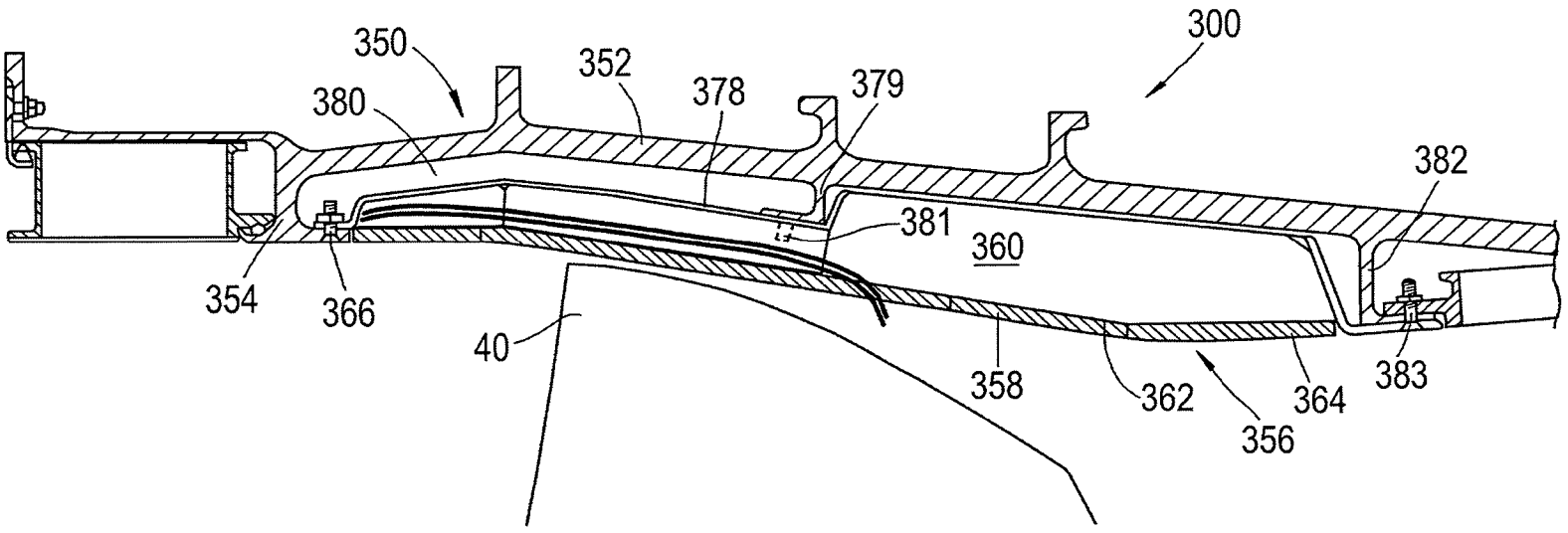
FIG. 4 is a partial cross-section through a fan blade containment system.
Figure 6:
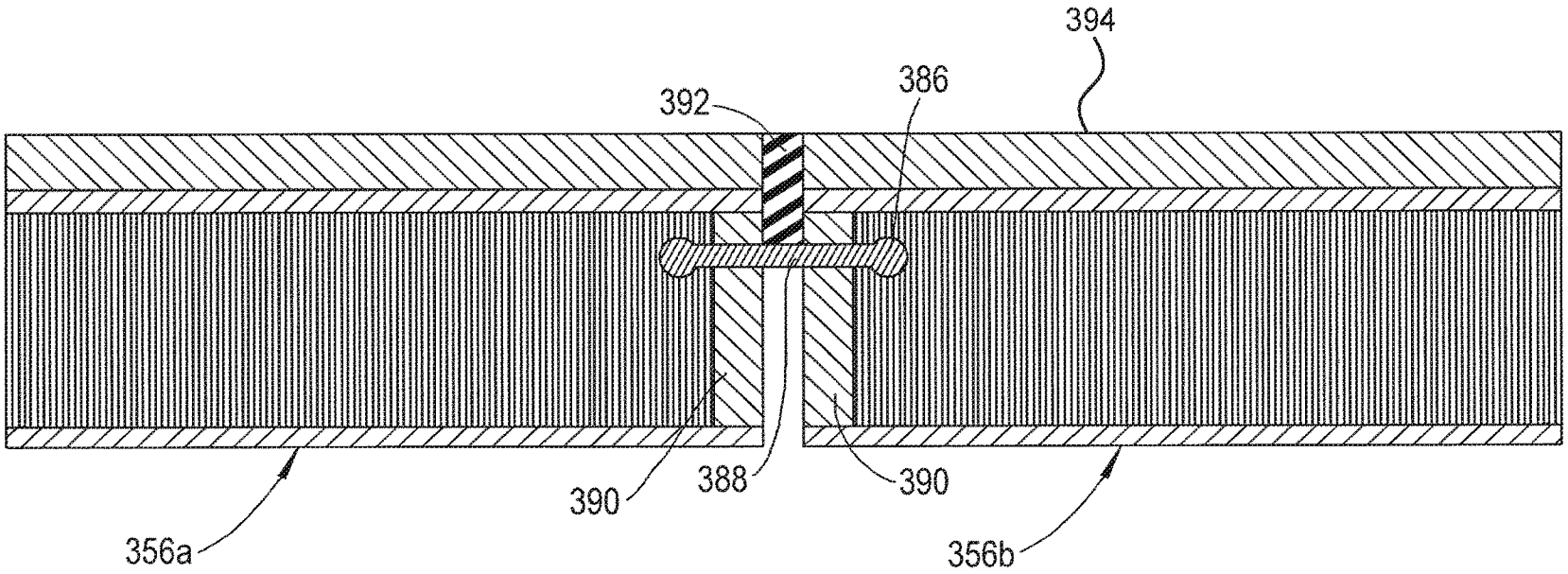
FIG. 6 is schematic view through a circumferential cross section of two fan track liner panels of the containment system of FIG. 4.

Referring now to FIGS. 4 to 6, the fan containment system 300 is shown in more detail. The fan containment system 300 comprises a fan case 350. The fan case 350 includes an annular casing element 352 that, in use, encircles the fan blades 40 of the gas turbine engine 10. The fan case 350 further includes a hook 354 that projects from the annular casing element in a generally radially inward direction. The hook 354 is positioned, in use, axially forward of the fan blades 40 and the hook is arranged so as to extend axially inwardly, such that in a fan blade off scenario the hook 354 prevents the fan blade from exiting the engine 10 through the air intake duct 11.

In the present embodiment, the hook 354 is substantially L-shaped and has a radial component extending radially inwards from the annular casing element 352 and an axial component extending axially rearward towards the fan blades 40 from the radial component.

A fan track liner 356 is connected to the fan case 350 at the hook 354 via a connector. The connector biases the fan track liner to a position substantially aligned with the lower end of the hook 354 and permits movement of the fan track liner relative to the hook when a pre-determined force is applied to the fan track liner. In the present embodiment, the connector includes a plurality of circumferentially spaced fasteners 366 designed to shear/fracture at a predetermined load such that movement of the fan track liner radially outwards towards the annular casing element 352 is permitted when a load exerted on the fan track liner exceeds the predetermined level (in alternative embodiments an alternative fastening mechanism may be used e.g. a crushable collar or a sprung fastener).

The fan track liner 356 includes a tray 378 to which an intermediate layer 360 is connected (e.g. bonded). An attrition layer (or abradable layer) 358 is positioned, in use, proximal to the fan blades 40. In the present embodiments, a septum layer 362 is the interface between the attrition layer and the intermediate layer, forming part of the bond between the two. The septum layer 362 also separates the attrition layer and the intermediate layer and distributes any applied load between the attrition layer and the intermediate layer. The tray 378 is connected to the hook 354 via the fastener 366 so as to connect the fan track liner 356 to the fan case 350. The attrition layer 358 has a rearward portion 364 that is constructed to provide increased ice impact resistance (e.g. to replace a more conventional GRP ice impact panel).

A forward portion of the fan track liner 356 is spaced radially inward from the annular casing element 352 so that a voidal region 380 is formed between the forward portion of the fan track liner 356 and the casing element 352.

A standoff 379 protrudes radially inwardly from the casing element 352. The standoff is positioned axially between a forward end of the fan track liner and a rearward end of the fan track liner. Each fan track liner panel is connected to the standoff via a fastener 381, e.g. a bolt. The fastener 381 is covered by the intermediate layer 360 and/or attrition layer 358 so that the fan track liner panels have a substantially smooth gas washed surface 394.

A support member 382 protrudes radially inwards from the annular casing element 352. In the present embodiment, the support member 382 is formed of a series of circumferentially spaced L-shaped protrusions, but in alternative embodiments the support member may extend fully around the annular casing element (i.e. with no interruptions/spacing). A rearward end of the fan track liner 356 is connected to the support member 382. In the present embodiment, the fan track liner 356 is connected to the support member via the tray and the attrition liner using a plurality of fasteners 383. The connection and manufacturing tolerances of the annular casing to the support member is such that any step between the fan track liner and adjacent panel (e.g. acoustic panel) will be out-of-flow (i.e. stepped radially outward) so as to improve aerodynamics.

The fan track liner 356 is formed of a plurality of arcuate fan track liner panels 356*a*, 356*b* positioned adjacent to each other such that an axis of each arcuate fan track liner is substantially co-axial so to form a substantially frusto-conical fan track liner, a substantially cylindrical fan track liner, or a fan track liner having one or more cylindrical portions and a frusto-conical portion. The axial sides (and axial faces) of each panel are substantially parallel to the longitudinal axis of the gas turbine engine.

A groove 386 is provided on each axial face of the fan track liner panels 356*a*, 356*b*. In the present embodiment the groove is curved, but in alternative embodiments at least a portion of the groove may be straight. The groove includes a rear portion that is curved in a direction towards the gas washed surface. The groove extends from the gas washed surface to a position adjacent the hook. In the present embodiment the groove is provided only in the forward portion of the fan track liner, i.e. extending from an axial position adjacent to the hook to an axial position adjacent the stand-off.

A coupling 388 is provided circumferentially between the first and second fan track liner panels 356*a*, 356*b*. The coupling may be considered to be of a dog bone shape. The coupling includes a central elongate section that bridges the circumferential gap between the first and second fan track liner panels. The central elongate section is of substantially constant thickness, e.g. the central section is substantially rectangular in cross section. The circumferential ends of the coupling are bulbous, e.g. they are substantially cylindrical (i.e. they have a substantially circular cross section).

The grooves 386 in the fan track liner panels are shaped to accommodate a portion of the coupling. In the present embodiment the grooves include a rectangular slot adjoined to a cylindrical slot. The rectangular slot is dimensioned to be a close fit or a sliding fit with the elongate portion of the coupling and/or the cylindrical slot is dimensioned to be a close fit or a sliding fit with the bulbous ends of the coupling, such that the coupling can be slid along the groove to locate the coupling between the two fan track liner panels.

In the present embodiment the panels comprise a support 390 or edging along the axial faces of the fan track liner panels 356*a*, 356*b*. The support may be formed by filling a portion of the intermediate layer (which in this embodiment is a honeycomb structure) with a filler material, for example an epoxy based filler or a foamed phenolic. The supports 390 provide additional support for the coupling 388.

The coupling 388 is relatively flexible in the axial direction so that it can flex as it is slid along the curved groove during assembly or disassembly. The coupling 388 is relatively stiff in the radial direction and in the circumferential direction. The function of the flexibility and stiffness will be described in more detail in relation to the assembly of the containment system and the use of the containment system.

The material used to form the coupling can be selected based upon the loading requirements of a particular fan casing. In exemplary embodiments, the coupling may be made from sprung steel, plastic or GRP (glass reinforced plastic). The coupling may be coated, for example the coupling may be coated with a polyethylene (PE), polypropylene (PP), or Polytetrafluoroethylene (PTFE) coating. The coupling may be coated with an anti-corrosion coating and/or a friction reducing coating to ease sliding of the coupling into the groove.

A sealant 392 is provided on a radially inner side of the coupling 388. The sealant extends to a position adjacent a radially inner surface of the fan track liner panels 356*a*, 356*b*, so as to form a smooth gas washed surface. In some embodiments some sealant may be provided at a radially inner end of the groove (that is the entrance to the groove provided on the gas washed surface) so as to provide a smooth gas washed surface, but in alternative embodiments the coupling may extend to the gas washed surface. The sealant may be formed from a similar material as the material used to form the attrition layer e.g. an epoxy resin.

To assembly the fan containment system 300, the fan track liner panels are connected to the hook 354, to the standoff 379 and to the support 382. The coupling is then slid into the grooves of two adjacent fan track liner panels. Sealant is then applied as required. To remove the one or more of the fan track liner panels the sealant is removed and then the relevant coupling is slid out of the corresponding groove in the one or more fan track liner panels. In some embodiments, the sealant may be a different colour to the attrition layer to aid identification of the region of the liner that needs to be removed (i.e. the sealant) to remove the relevant coupling.

In the event of a fan blade 40 (or part of a fan blade) being released from the hub of the fan 12, the released fan blade will impact one of the fan track liner panels 356*a*, 356*b*. The fan blade 40 moves forwards in an axial and circumferential direction with respect to the fan track liner. As the fan blade 40 moves forward the attrition layer 358 is abraded and the intermediate layer 360 is compressed to absorb energy from the fan blade and slow down the speed of travel of the fan blade. Impact of the fan blade 40 with the fan track liner panel 356*a*, 356*b* also causes one or more of the fasteners 366 to fail permitting the fan track liner panel to pivot about the standoff 379 into the voidal region 380. Movement of the fan track liner, abrasion of the attrition layer and deformation of the intermediate layer means that when the released fan blade reaches the axial position of the hook 354, the released fan blade impacts the hook and is held by the hook 354 and further axially forward movement is prevented. A trailing blade then forces the held released fan blade rearwards where the released fan blade is contained.

As will be appreciated by the person skilled in the art, the coupling provides a connection between adjacent fan track liner panels. This connection can help to reduce vibration of the fan track liner panels during operation of the gas turbine engine. Furthermore, the coupling can contribute to improved fan blade capture performance of the containment system. In fan containment systems of the prior art having a plurality of fan track liner panels, when a fan blade or part of a fan blade is released, if the fan blade impacts a junction between two adjacent fan track liner panels at a position close to the hook then there is a risk that the adjacent panel will not move towards the annular casing element and so the released fan blade can "jump" over the hook instead of being retained. The connection created by the coupling increases the likelihood of the adjacent panel moving towards the annular casing element and therefore the released fan blade being retained by the fan containment system. The coupling flexes when a connected panel is impacted by a released fan blade so as to transfer load to an adjacent panel.

The use of the coupling means that straight-sided panels can be used with a releasable mechanism of fastening the panels to the casing. Straight-sided panels can be much easier to manufacture than panels having a more complex shape.

The flexibility of the coupling in the circumferential direction can be selected to accommodate casing distortion, in particular casing distortion that occurs during and after a fan blade being released from the fan.

The coupling can be easily removed to aid replacement and/or maintenance of a damaged panel. In embodiments where the coupling is made from a ferromagnetic material (such as steel) and the intermediate layer is made from a non-magnetic material such as aluminium honeycomb, the thickness of the attrition layer of the fan track liner can be determined by non-destructive measurement.

It will be appreciated by one skilled in the art that, where technical features have been described in association with one embodiment, this does not preclude the combination or replacement with features from other embodiments where this is appropriate.

Furthermore, equivalent modifications and variations will be apparent to those skilled in the art from this disclosure. Accordingly, the exemplary embodiments set forth above are considered to be illustrative and not limiting.

Figure 7:
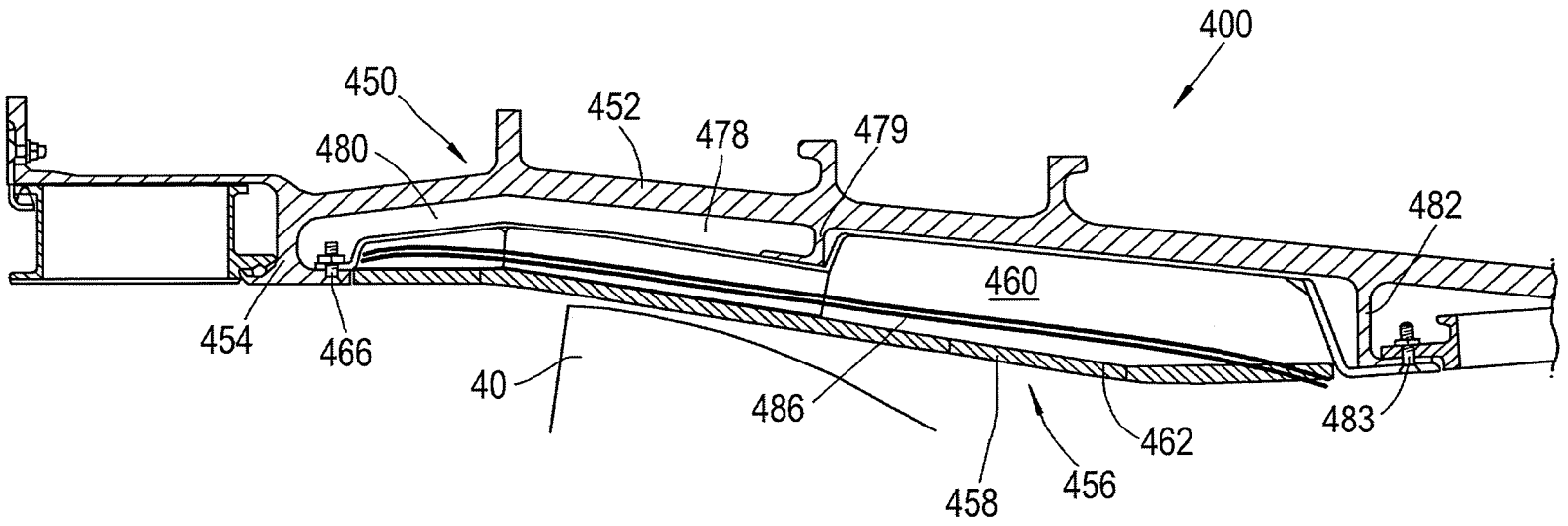
FIG. 7 is a partial cross-section through an alternative fan blade containment system.

An example alternative embodiment is illustrated in FIG. 7. In FIG. 7 similar reference numerals to those used in the embodiment of FIGS. 4 to 6 are used for similar features, but with a prefix "4" instead of "3". Only the principle differences between the embodiment of FIGS. 4 to 6 and the embodiment of FIG. 7 will be described.

In the fan containment system 400 of FIG. 7, the grooves 486 provided in the axial faces of the fan track liner panels extend substantially the full axial length of the fan track liner panel, instead of only extending along the forward portion of the fan track liner panel. The coupling (not shown in FIG. 7) also extends along substantially the full axial length of the fan track liner panel. Similar to previously described embodiment the groove is curved in a region adjacent the hook and a region adjacent the gas washed surface of the fan track liner, but in the present embodiment a central region of the groove is straight.

Figure 8:
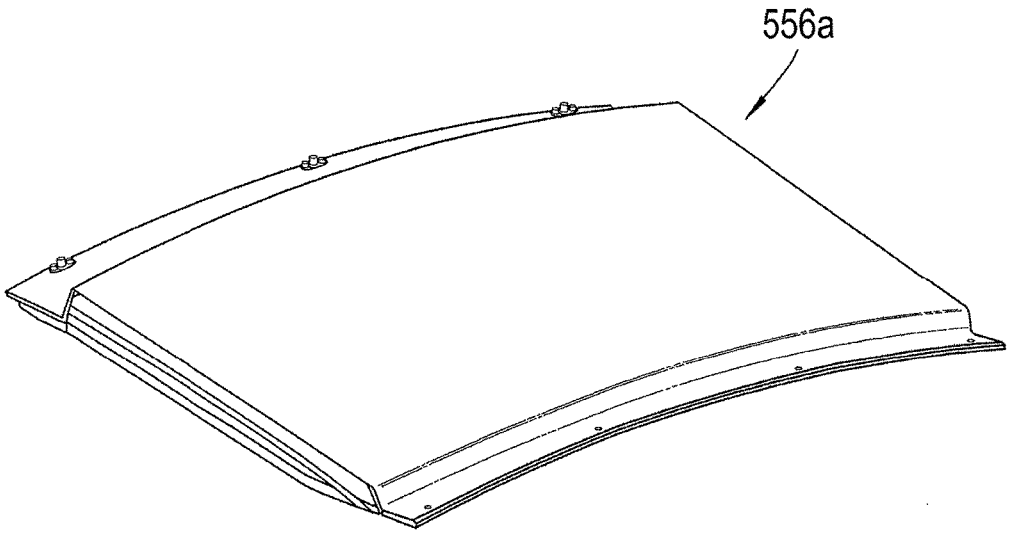
FIG. 8 is a perspective view from a gas washed surface of a fan track liner panel.

In FIG. 8, a fan track liner panel 556*a* of a further alternative embodiment is shown. The fan track liner panel 556*a* includes a slot that extends the full length of the panel. The difference between the panel of FIG. 8 and the panel of FIG. 7 is principally that the panel of FIG. 7 has a constant thickness along the axial length of the panel, instead of having an increased thickness in a rearward portion of the panel compared to a forward portion of the panel.

In the described embodiments the intermediate layer of the fan track liner is an aluminium honeycomb structure, but in alternative embodiments an alternative intermediate layer may be used (e.g. a foam (for example a metal or synthetic foam)) or a honeycomb structure made from a material other than aluminium (for example a meta-aramid material)). The intermediate layer of the described embodiments is formed of the same material in a radial direction. However, in alternative embodiments, the intermediate layer may be formed of one or more radial layers (e.g. sub-layers) connected together via a septum layer. The radial layers may be of different densities, so as to vary the properties of the intermediate layer in a radial direction.

In the described embodiments the coupling interacts with slots in the intermediate layer, but in alternative embodiments slots for interacting with the coupling may be formed in the septum layer. If the slots are provided in the septum layer it may not be necessary to provide supports in the region of the slots.

In the described embodiment, the fan track liner panels are connected to the standoff, but in alternative embodiments the fan track liner panel may only be connected at the hook and rearward support. In such embodiments the fan track liner panel may include a hinged portion and/or the fan track liner may be connected the annular casing element via some other suitable mechanism.

The fan track liner panels have been described as having sides that are substantially parallel to the axial direction, but the fan track liner panels may have any suitable shape, for example the fan track liner panels may be curved or angled, e.g. angled or curved in the direction of rotation of the fan.

The invention claimed is:

1. A fan containment system for fitment around an array of radially extending fan blades mounted on a hub in an axial gas turbine engine, the fan containment system comprising:

a fan case having an annular casing element for encircling the array of fan blades and a hook projecting in a generally radially inward direction from the annular casing element and positionable axially forward of an array of fan blades when the fan containment system is fitted around said fan blades;

an annular fan track liner comprising a first fan track liner panel positioned circumferentially adjacent a second fan track liner panel, wherein each of the first and second fan track liner panels are connected to the fan case at the hook via one or more connectors configured to permit movement of the respective first or second fan track liner panel relative to the hook such that the first and/or second fan track liner panel can pivot towards the annular casing element when a released fan blade impacts the first and/or second fan track liner panel; and a coupling for connecting the first fan track liner panel to the second fan track liner panel, wherein the first fan track liner panel and the second fan track liner panel each comprise a groove along an axial face thereof and a first portion of the coupling is received in the groove of the first fan track liner and a second portion of the coupling is received in the groove of the second fan track liner, each of the grooves being formed to have a rectangular portion adjoined to a cylindrical portion, and wherein the received first portion and the received second portion of the coupling completely fill a space associated with each groove such that an external surface of the received first portion and of the received second portion, respectively, engage a corresponding internal surface of the first fan track liner and of the second fan track liner along an entire periphery of the received first portion and the received second portion.

2. The fan containment system according to claim 1, wherein circumferential ends of the coupling are bulbous in shape.

3. The fan containment system according to claim 1, wherein the coupling is coated using an anticorrosion and/or friction reducing coating.

4. The fan containment system according to claim 1 comprising sealant provided on a radially inner surface of the coupling and forming a portion of a gas washed surface of the fan containment system.

5. The fan containment system according to claim 4 wherein the sealant engages with the coupling.

6. The fan containment system according to claim 1, wherein the first and the second panels are substantially rectangular in shape.

7. The fan containment system according to claim 1, wherein the coupling extends along a forward portion of the first and second fan track liner panels.

8. The fan containment system according to claim 7, wherein the coupling extends along an entire length of the first and second fan track liner panels.

9. The fan containment system according to claim 1, wherein the groove provided in the first and second fan track liner panels is curved towards a gas washed surface in a direction away from the hook.

10. The fan containment system according to claim 1, wherein the fan case comprises a standoff positioned downstream of the hook and wherein the first and the second fan track liner panels are removably connected to the standoff.

11. The gas turbine engine comprising the fan containment system according to claim 1.

12. A method of assembly of a fan containment system, the method comprising:

providing a fan case having an annular casing element for encircling an array of fan blades and a hook projecting in a generally radially inward direction from the annular casing element and positionable axially forward of the array of fan blades when the fan containment system is fitted around said fan blades;

connecting a first fan track liner panel to the annular casing element and connecting a second fan track liner panel to the annular casing, the second fan track liner panel being positioned circumferentially adjacent the first fan track liner panel, and wherein the first and second fan track liner panels comprise a groove along an axial side; and sliding the coupling along the groove of the first and second fan track liner panel, such that the coupling connects the first fan track liner panel to the second fan track liner panel, wherein the a first portion of the coupling is received in the groove of the first track liner and a second portion of the coupling is received in the groove of the second fan track liner, each of the grooves being formed to have a rectangular portion adjoined to a cylindrical portion, and wherein the received first portion and the received second portion of the coupling completely fill a space associated with each groove such that an external surface of the received first portion and of the received second portion, respectively, engage a corresponding internal surface of the first fan track liner and of the second fan track liner along an entire periphery of the received first portion and the received second portion.

13. A fan containment system for fitment around an array of radially extending fan blades mounted on a hub in an axial gas turbine engine, the fan containment system comprising:

a fan case having an annular casing element for encircling the array of fan blades and a hook projecting in a generally radially inward direction from the annular casing element; and an annular fan track liner comprising:

a plurality of fan track liner panels; and a plurality of couplings;

wherein each fan track liner panel comprises a groove extending along both axial faces of each fan track liner panel and a first portion of one of the plurality of couplings is received in the groove of a first fan track liner of the plurality of fan track liners and a second portion of the coupling is received in the groove of a second fan track liner of the plurality of fan track liners, each of the grooves being formed to have a rectangular portion adjoined to a cylindrical portion, and wherein the received first portion and the received second portion of the coupling completely fill a space associated with each groove such that an external surface of the received first portion and of the received second portion, respectively, engage a corresponding internal surface of the first fan track liner and of the second fan track liner along an entire periphery of the received first portion and the received second portion.

* * * * *